US006857362B1

(12) United States Patent
Goss

(10) Patent No.: US 6,857,362 B1
(45) Date of Patent: Feb. 22, 2005

(54) PAD PRINTER CARTRIDGE AND RECIPROCATING TABLE HAVING BEARING MEMBERS

(75) Inventor: Duke W. Goss, Kirkland, WA (US)

(73) Assignee: Printa Systems Inc., Kirkland, WA (US)

( * ) Notice: Subject to any disclaimer, the term of this patent is extended or adjusted under 35 U.S.C. 154(b) by 0 days.

(21) Appl. No.: 10/470,578

(22) Filed: Jan. 28, 1998

Related U.S. Application Data

(63) Continuation-in-part of application No. 08/742,146, filed on Oct. 31, 1996, now abandoned.

(51) Int. Cl.[7] ..... B41F 17/00
(52) U.S. Cl. ..... 101/163; 101/41; 101/407.1
(58) Field of Search ..... 101/35, 41, 44, 101/170, 163, 164, 167, 169, 407.1, 474, 158, 159

(56) References Cited

U.S. PATENT DOCUMENTS

| | | | | | |
|---|---|---|---|---|---|
| 4,314,504 | A | * | 2/1982 | Combeau | 101/41 |
| 4,779,531 | A | * | 10/1988 | Ueno et al. | 101/163 |
| 5,158,018 | A | * | 10/1992 | Masaki et al. | 101/158 |
| D340,256 | S | * | 10/1993 | Ng | D18/14 |
| 5,272,972 | A | * | 12/1993 | Tobita | 101/163 |
| 5,272,973 | A | * | 12/1993 | Chojnacki | 101/163 |
| 5,476,040 | A | * | 12/1995 | Kleist | 101/163 |
| 5,577,442 | A | * | 11/1996 | Tanaka et al. | 101/163 |

* cited by examiner

*Primary Examiner*—Leslie J. Evanisko
(74) *Attorney, Agent, or Firm*—Delbert J Barnard

(57) ABSTRACT

An improved table and ink wipe cartridge for a pad printer consists of a table mounted to a base by a pair of parallel, nylon bearings. The bearings enable the table to slide back and forth easily without requiring conventional ballbearings and guides. The cartridge automatically rolls and wipes ink on a print tray carried by the table.

12 Claims, 14 Drawing Sheets

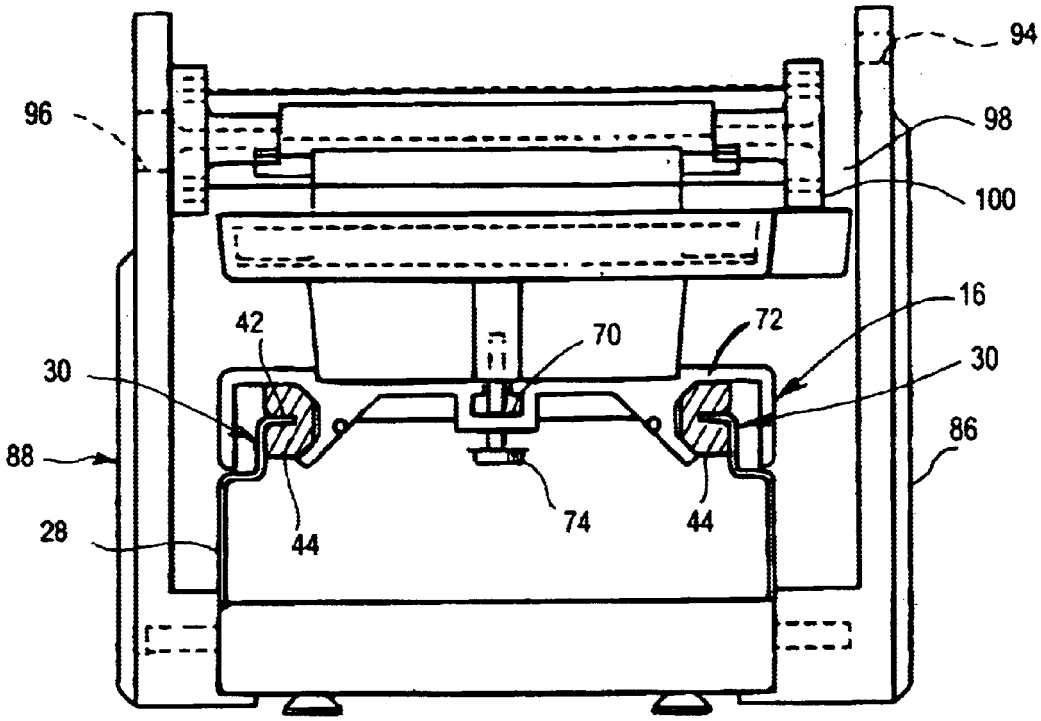
FIG.3A
FIG.3B
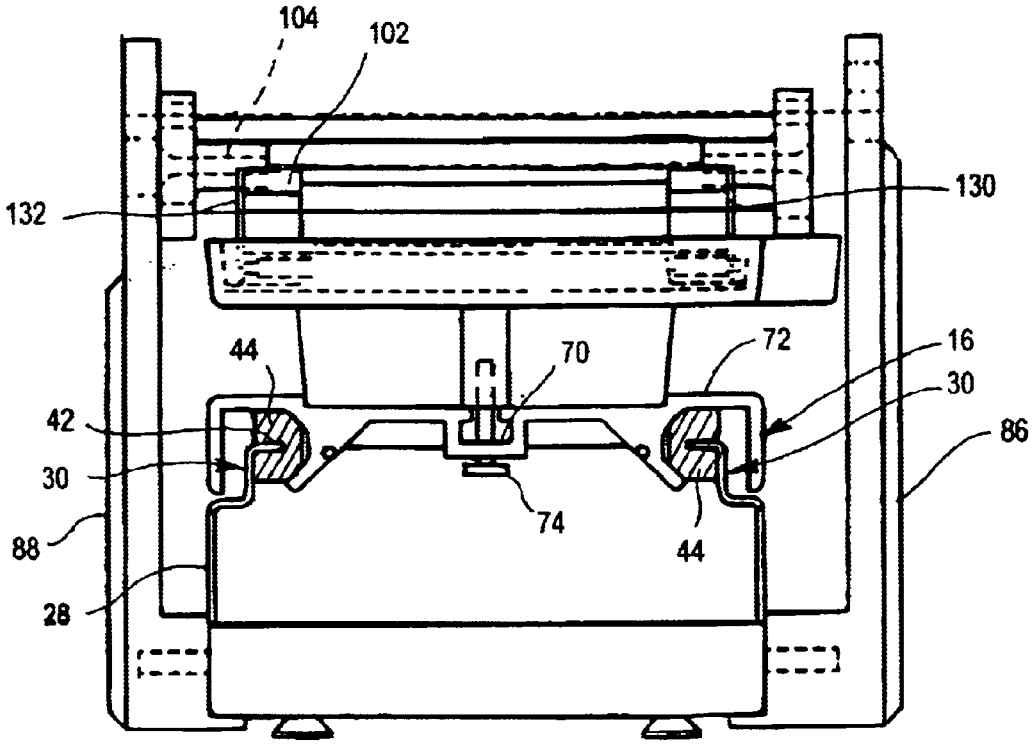

PAD PRINTER CARTRIDGE AND RECIPROCATING TABLE HAVING BEARING MEMBERS

RELATED APPLICATION

This application is a continuation-in-part of application Ser. No. 08/742,146, filed Oct. 31, 1996 now abandoned.

TECHNICAL FIELD

This invention relates to pad printers. More particularly, it relates to an improved reciprocating table and an improved inking and wiping structure for a pad printer.

BACKGROUND OF THE INVENTION

Pad printing devices have been in existence for a long period of time. Pad printers are typically used to transfer custom images from an ink pad to a non-planar surface. The most familiar use of pad printers is probably the printing of company names and logos on coffee cups, pens, golf balls, and the like.

Many pad printers are fully automatic, commercial printers that are capable of printing items in large volume. Commercial printers are very large machines and tend to be very expensive. At today's prices, some commercial printers cost as much as $100,000.

The expense of a commercial printer is justified for some companies. A golf ball manufacturer, for example, needs a commercial printer because it has to print its trademarks and model numbers on many thousands or millions of golf balls. Other companies do not print items at volumes that justify the expense of a commercial printer. They still have printing needs, however, which has created a market for smaller, hand-operated pad printers.

In order to avoid confusion, when the term "pad printer" is used below, it means the hand-operated kind. "Commercial printer" means the fully automated kind. However, this nomenclature is not meant to limit the scope of what is considered to be the invention. In some cases, for example, it may be possible to automate the operation of certain pad printers which are normally hand-operated. Or a pad printer may be semiautomatic in operation and still be regarded as a "pad printer" in the context of the invention described here. Consequently, the term should be taken as covering any type of pad printer whether or not it is hand-operated or fully automatic.

One of the most common hand-operated pad printers on the market today is a Japanese multi-pad printer manufactured by the Kobo Company. The Kobo printer has a hand-operated table which carries both a turntable and a print plate/ink reservoir tray ("print tray"). Moving the table back and forth respectively positions the turntable and print tray below a print pad.

The print pad is hand-operated by a spring-biased crank handle. The crank handle moves the print pad vertically up and down relative to the table.

Ink is swiped across a print plate held in the print tray as the tray is moved below the print pad. The crank arm is then pulled down, which correspondingly moves the print pad down onto the print plate, thereby causing the pad to pick up an ink image (company logo, etc.) from the print plate. Then, the crank handle is released. The spring action of the handle causes it to return to its initial position which also vertically raises the print pad relative to the table.

The table is then moved to bring the turntable directly below the print pad. The turntable carries the item (coffee mug or the like) upon which the image is to be printed. At that point, the crank arm is once again pulled down to likewise bring the print pad into contact with the item, thereby printing the image on the item's surface.

The invention disclosed here generally operates in the same way as the pad printer described above. However, the invention improves upon existing pad printers in two ways.

First, the reciprocating tables of existing pad printers are mounted to a base by means of conventional metal rollers and tracks. While this type of construction certainly works well, it is also an overdesign relative to the way the typical pad printer is used. It is also an expensive component for the pad printer manufacturer. The present invention provides an alternative to the conventional roller and track design of a pad printer table which is much cheaper to make but still provides more than adequate design tolerances for the table.

Second, the conventional pad printer requires essentially three operations relating to table movement in order to transfer the image from the print plate (apart from the upward and downward operation of the printing pad). Two of the operations involve the basic back-and-forth reciprocating movement of the table for the purpose of respectively positioning the print tray and turntable below the print pad. The third operation involves wiping excess ink from the print plate carried by the print tray as it is moved below the print pad.

In the conventional pad printer, an operator must use one hand to move the table. When the print plate is moved below the print pad, the operator must, at the same time, use his free hand to operate an ink wipe in order to remove excess ink from the print plate. This also entails a certain amount of skill to insure that the ink is wiped from the plate in proper fashion. In the present invention, this step is completely eliminated and the ink wiping operation is fully automated.

SUMMARY OF THE INVENTION

The invention is an improved version of a pad printer. One part of the improvement relates to the way a reciprocating pad printer table carries a print tray or "ink tray unit," and a turntable for holding an item that is to be printed. The table is mounted to a base by a pair of parallel, spaced-apart bearing members. The bearing members are elongated in form and mounted directly to the base. They have inwardly directed surfaces with a defined geometry such that one bearing faces the other. The table member has outwardly facing channels with surfaces that slidingly mate with the bearing member surfaces. The bearing members are preferably made of nylon, high-density plastic, or another material which has a low coefficient of friction. This enables the table to slide easily along the bearing members.

The above design is really a "unibody" concept. In other words, the structural configuration of the base, in combination with the table, provides the means for connecting one to the other without intermediate guide and bearing structures.

In a second embodiment of the invention, the table slides along a set of bearings rotatably mounted on the base for slidingly engaging the table with the base. Each bearing functions like a roller assembly and has a surface that faces in a generally or mostly horizontal direction for cooperating with the table tracks. The horizontally facing directions of the bearing surfaces holds the table in a precise sliding alignment by creating a horizontal reactive force between the bearings and the table tracks. Ideally, there are two pairs of bearings mounted to the base with each pair mounted on opposite sides of the base. As with the first embodiment, the rolling surfaces of the bearings are preferably made of nylon or another material with a low coefficient of friction.

The ink tray unit has a cartridge whose function is to roll and wipe ink on an area of the ink tray. The cartridge has a frame which carries a first member or pivot plate. The pivot plate is rotatable relative to the frame. However, a pair of springs interconnects the pivot plate and frame and normally forces the plate in one rotational direction. A second member, also rotationally mounted to the cartridge frame, has a camming surface or surfaces arranged to abut and rotate the pivot plate against the bias of the spring when the second member is rotated. This camming and pivoting action brings an ink wipe, carried by the pivot plate, into contact with an area on the ink tray. The area carries a print plate bearing an image The pivot plate also carries a roller which rolls across the print plate as the pad printer table moves.

The second member is driven in rotation by a lever arm. The cartridge is fixed in position relative to the base of the pad printer and the pad printer table. In other words, the table and print tray move back and forth relative to the cartridge. Two portions or abutments protrude from the tray, hit the lever arm, and move it back and forth as the table moves in first one direction and then another. This raises and lowers the ink wiper in a coordinated action with the ink roller.

Alternatively the entire roller and wipe cartridge can be replaced by a sealed ink cup. Sealed ink cups are known in the art. They have an internal reservoir of ink, eliminating the need for a separate supply of ink in the ink reservoir of the ink tray unit. In operation, the ink cup is positioned over the ink tray unit. Ink in the cup diffuses from openings located on the flat, bottom surface of the ink cup and on to the image to be inked: As the pad printer table is moved back and forth, the bottom surface of the ink cup swipes across and inks the image.

The invention as summarized above will become more clearly understood upon reading the following description, which is to be taken in conjunction with the accompanying drawings.

BRIEF DESCRIPTION OF THE DRAWINGS

In the drawings, like reference numerals and letters refer to like parts throughout the various views, and wherein:

FIG. 3A is a left-end view of the base and table shown in FIG. 2A;

FIG. 3B is a left-end view of the base and table shown in FIG. 2B;

BEST MODE FOR CARRYING OUT THE INVENTION

Figure 1:
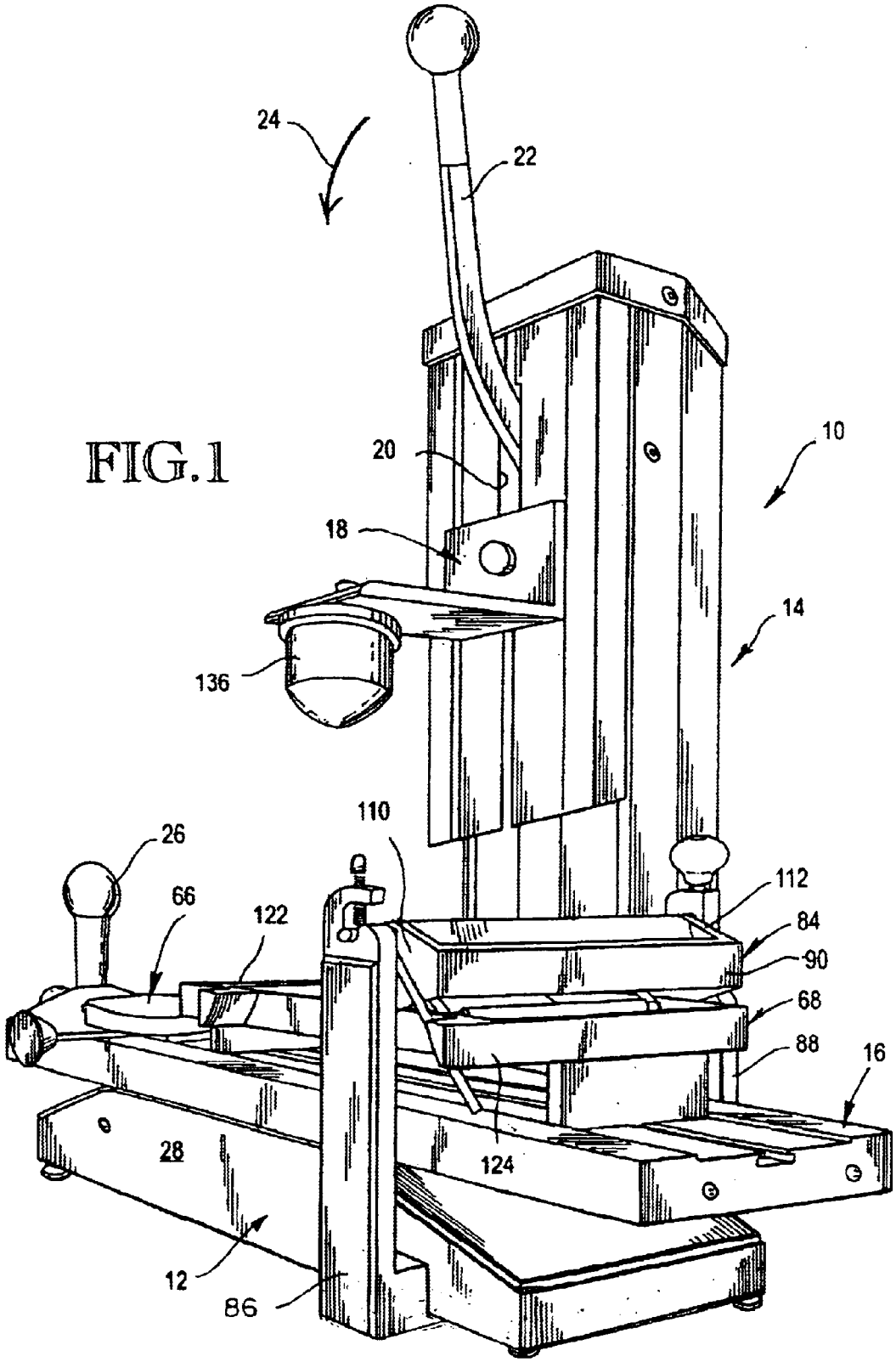
FIG. 1 is a pictorial view of an improved pad printer constructed in accordance with the invention.

Referring to the drawings, and first to FIG. 1, shown generally at 10 is a pad printer constructed in accordance with a preferred embodiment of the invention. The printer 10 has a base portion 12 and a tower portion 14. The base portion ("base") 12 carries a reciprocating table 16 which is slidingly mounted to the base in a manner that will be described later. The tower portion ("tower") 14 carries a printer pad support 18 which moves vertically upwardly and downwardly along a slot 20.

Upward and downward movement of the support 18 is controlled by a crank arm 22. When the crank arm 22 is pulled down in the direction indicated by arrow 24, it forces the pad support down along slot 20. The arm 22 is spring biased so that when it is released, the support 18 automatically returns to the position shown in FIG. 1. While the interior of the tower 14 includes an arrangement of guide rods, one or more springs, and mechanical connections between the arm 22 and support 18, this structure is conventional in nature. It is not illustrated in the drawings nor will it be further described here since it is not germane to the subject matter claimed as the invention.

Figure 2A:
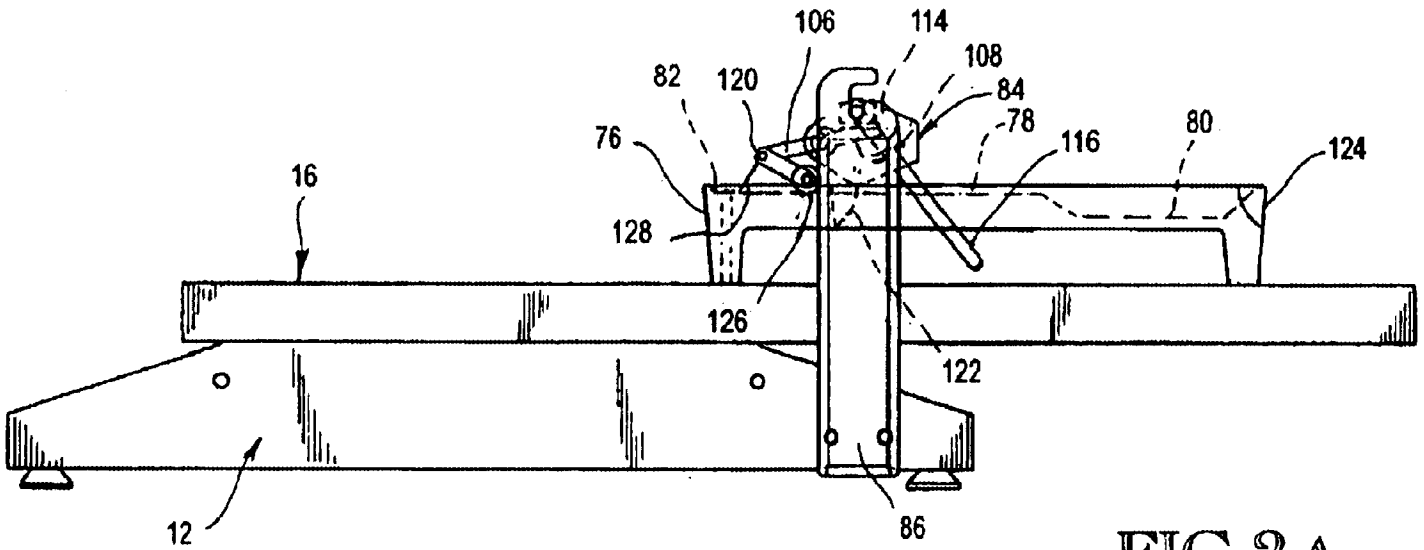
FIG. 2A is a side view of the base and reciprocating table portion of the pad printer shown in FIG. 1, and shows the table moved to the right for inking and wiping a print plate.

The table 16 has a handle 26 mounted to its left end. The handle 26 enables an operator to slide the table back and forth between the positions shown in FIGS. 2A and 2B, respectively. The table 16 is constructed from extruded aluminum or a similar material.

Figure 4:
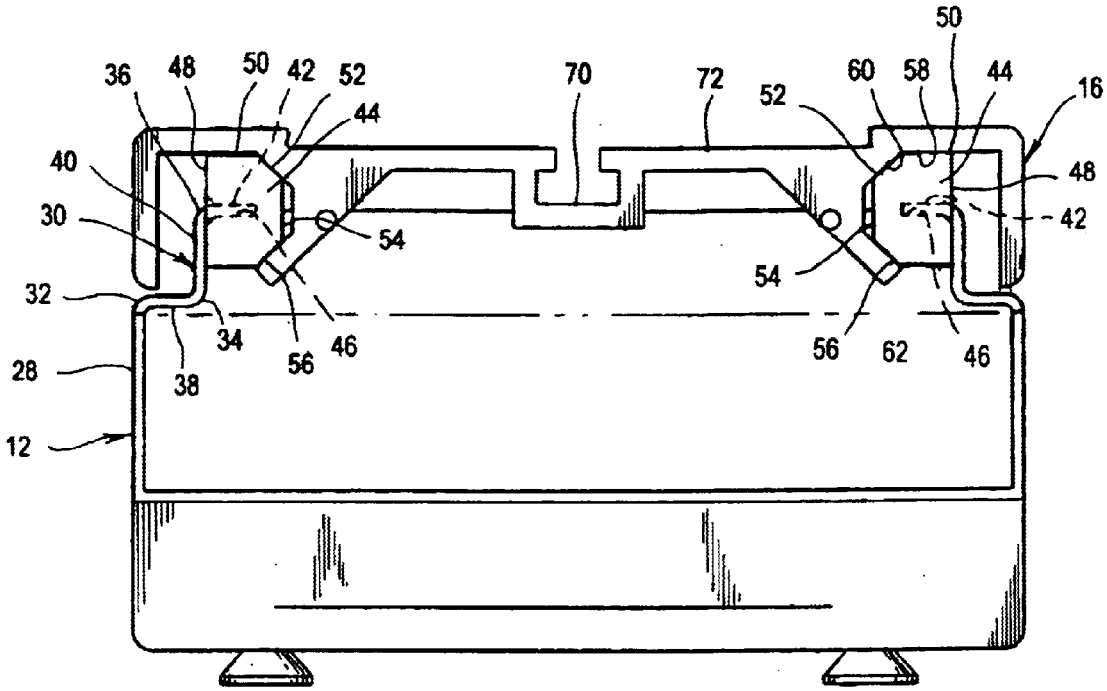
FIG. 4 is an end view of the base and table shown in FIGS. 2A–3B with the ink tray unit removed.

The base 12 is made from sections of sheet metal. The forward and rearward faces of the base, which are indicated by reference numeral 28 appear to have a hexagonal shape. However, referring now to FIG. 4, each face plate 28 has an upper section 30 that is created by a series of three bends 32, 34, 36. The first bend 32 creates a short, inwardly directed horizontal flange section 38. The second bend 34 creates a short, vertical section 40 that extends upwardly. The third bend 36 creates another horizontal flange section 42. This configuration is mirrored on both sides of the base 12. Consistent with the terminology used in the claims, the horizontal flange section 42 on each side creates a pair of elongated, inwardly extending "flange portions."

The face plates 28 are symmetrically bent and connected to the base 12 so that the flange sections 42 on each side of the base are substantially parallel and coplanar. A bearing strip 44 is attached to each flange section 42. The bearing strip 44 is made of nylon, high density plastic, or a similar material. It has a slot 46 in its back side 48 which extends along its entire length. The slot 36 receives the flange section 42. As a whole, the cross section of the bearing strip 44 is hexagonal. It has outer faces 50, 52, 54, 56 which slide against correspondent inner surfaces 58, 60, 62 of the table 16.

Figure 5:
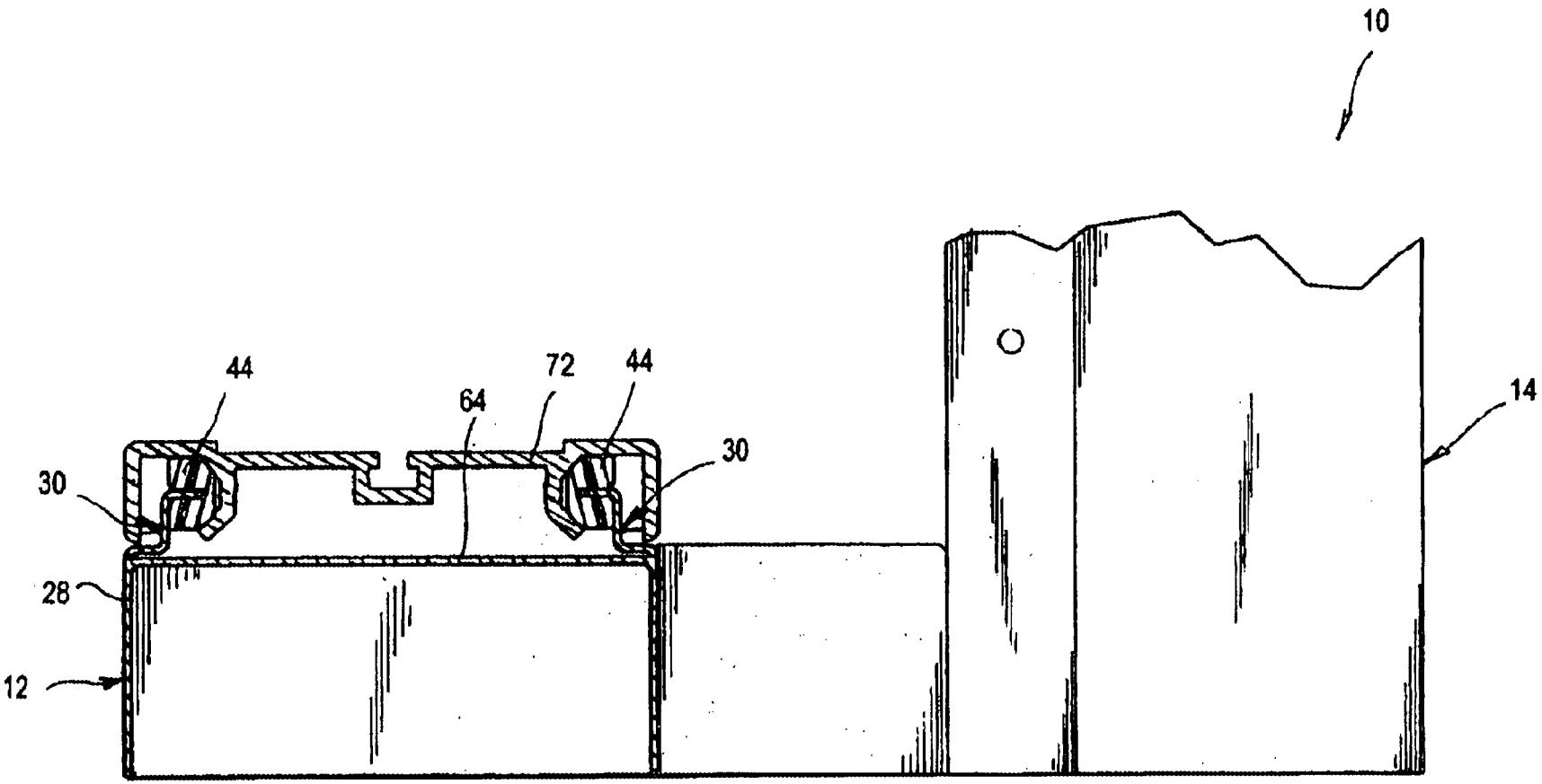
FIG. 5 is a view like FIG. 4 but shows the relationship of the base and table relative to a tower which carries the print pad.
Figure 6:
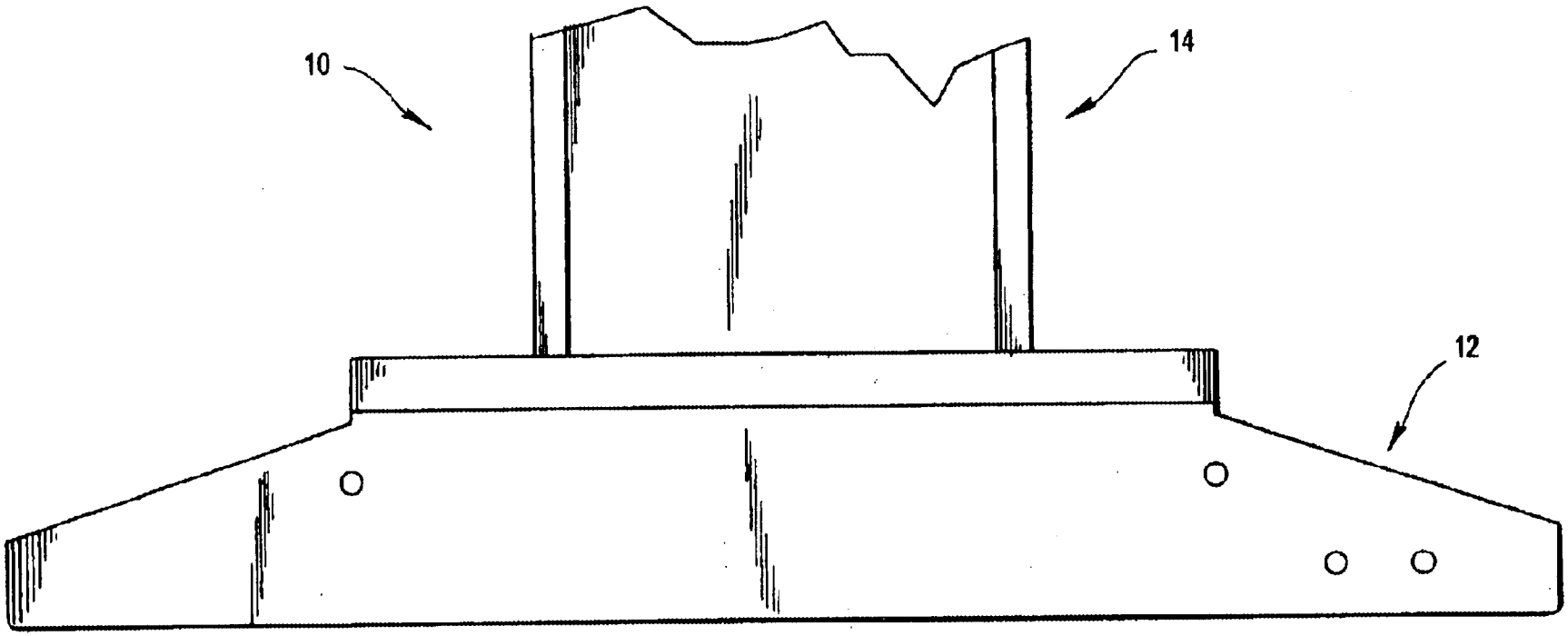
FIG. 6 is a side view of the base.
Figure 7:
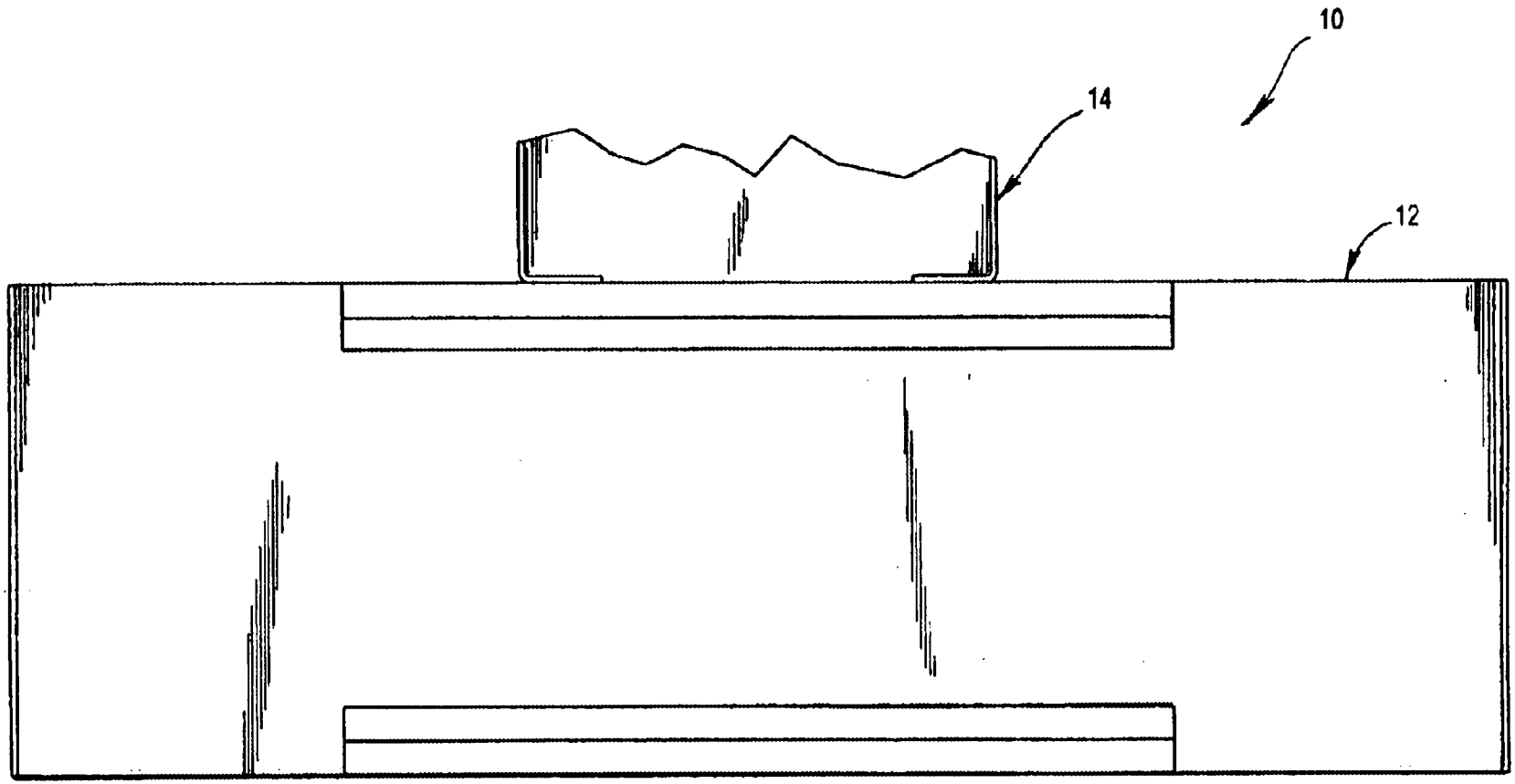
FIG. 7 is a top view of the base.
Figure 8:
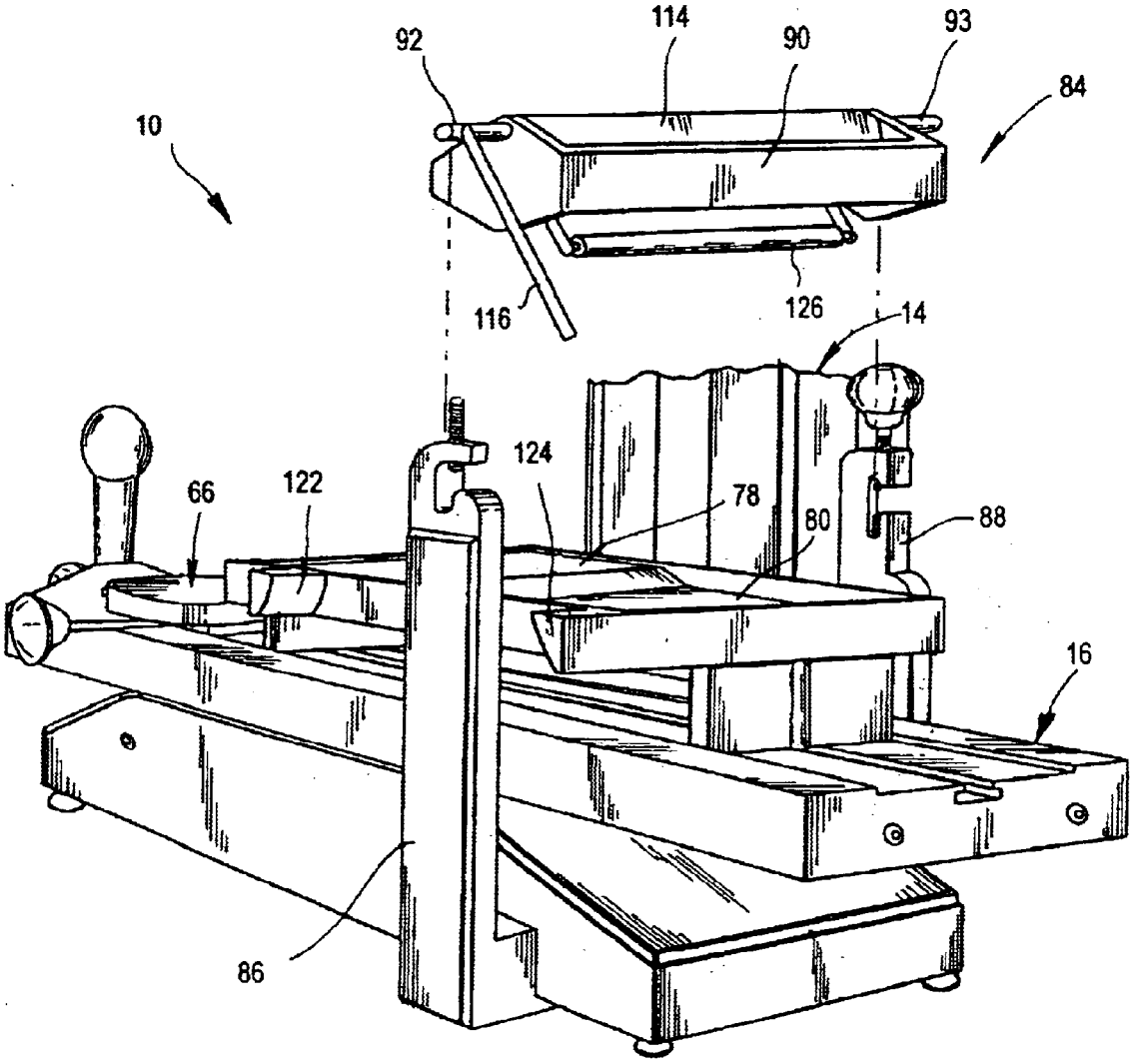
FIG. 8 is a pictorial view of the lower portion of the pad printer shown in FIG. 1, and shows a roller and wipe cartridge exploded upwardly from the table.
Figure 9:
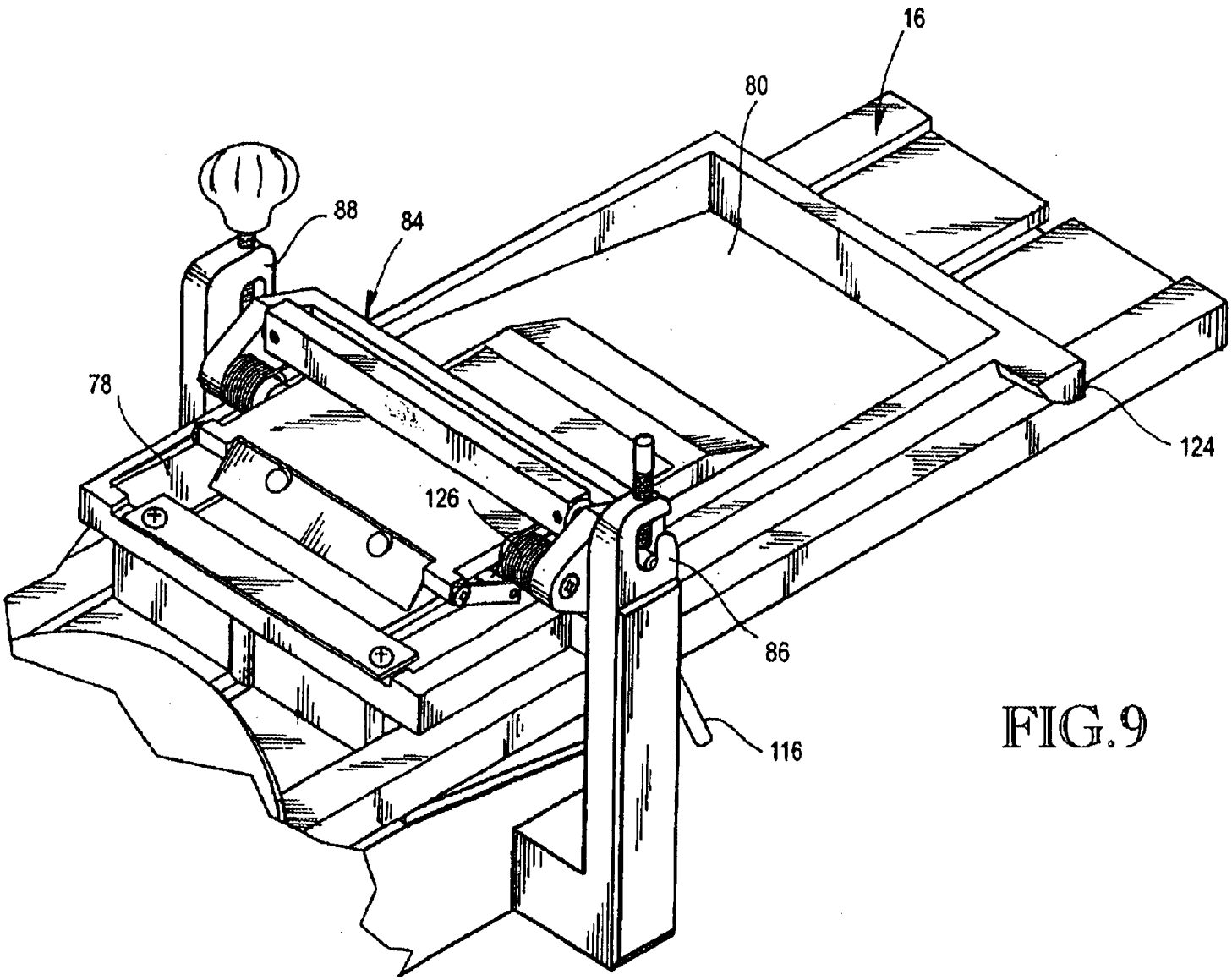
FIG. 9 is a pictorial view of an ink tray unit carried by the table.
Figure 10:
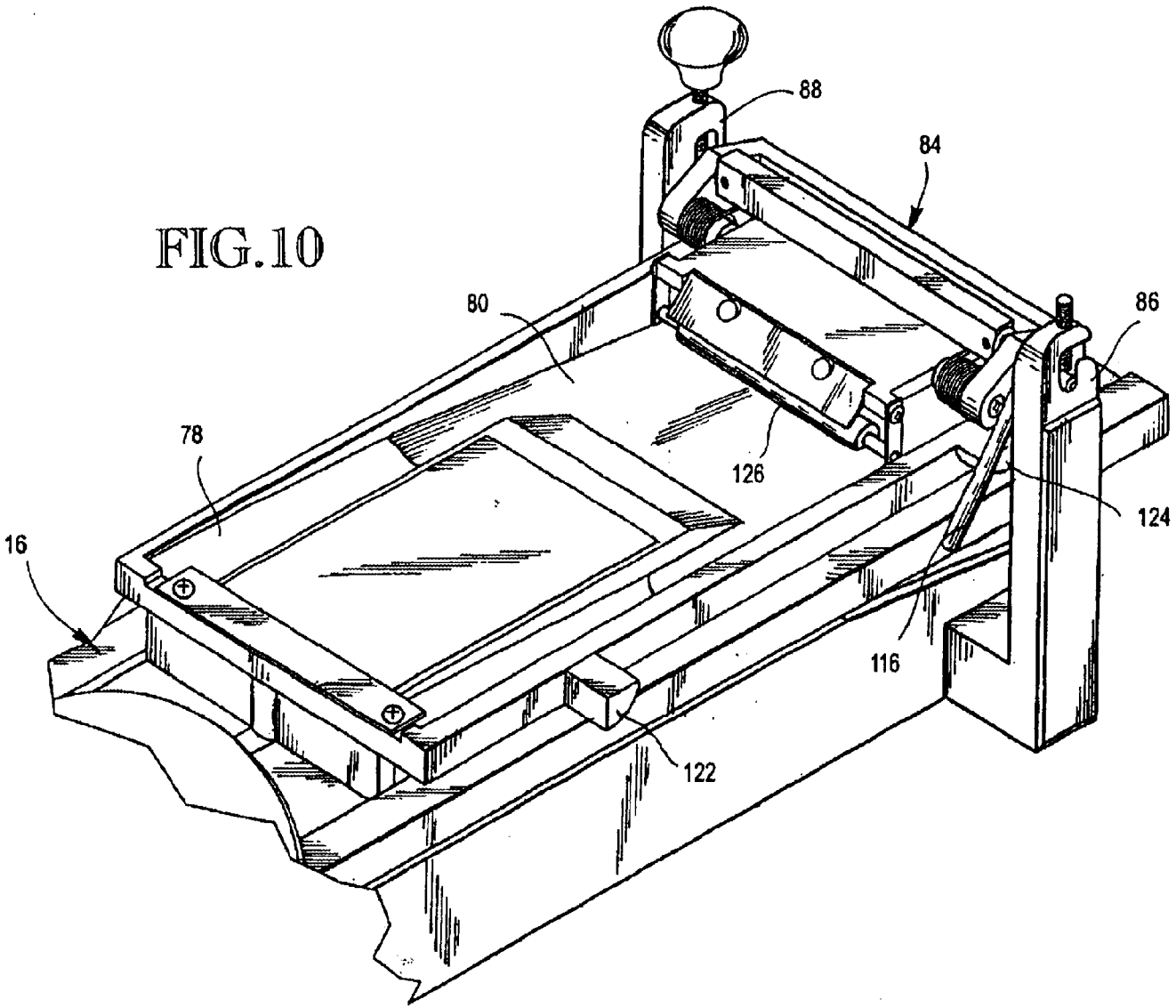
FIG. 10 is a view like FIG. 9, but shows the ink tray unit in a different position corresponding to movement of the table.

The shape-mating arrangement of the inwardly-facing bearing and outwardly-facing table surfaces, as described above, serves to hold the table in place so that it may slide back and forth along the bearings 44. Thus, it is readily apparent that the structure just described provides a very easy-to-make way of mounting a sliding table to a base that is much less complicated and less expensive when compared to conventional bearings and guides. Referring to FIG. 5, the structure just described is stiffened by an upper shield or upper face plate 64 which extends from one side of the base to the other.

It should be understood from the above description that the bearing strips 44 on each flange section 42 will be elongated to a certain degree lengthwise for the purpose of guiding the table 16 relative to the base 12. However, rather than have a single, elongated bearing strip 44 on each side, each strip 44 could be sectioned into two or more strips per side with spaces in between. It is possible, although it is not presently certain, that this alternative arrangement may prove to be the best design for use in the marketplace.

Alternatively, it may be possible to replace the nylon bearings 44 described above with rollers mounted directly to the frame at angles designed to roll against tracks in the table 16. Having an arrangement of parallel rollers angled against opposing track faces could function equivalently to the structure described above. In this case, the base 12 provides the guiding framework by carrying rollers rather than bearing strips 44.

Figure 14:
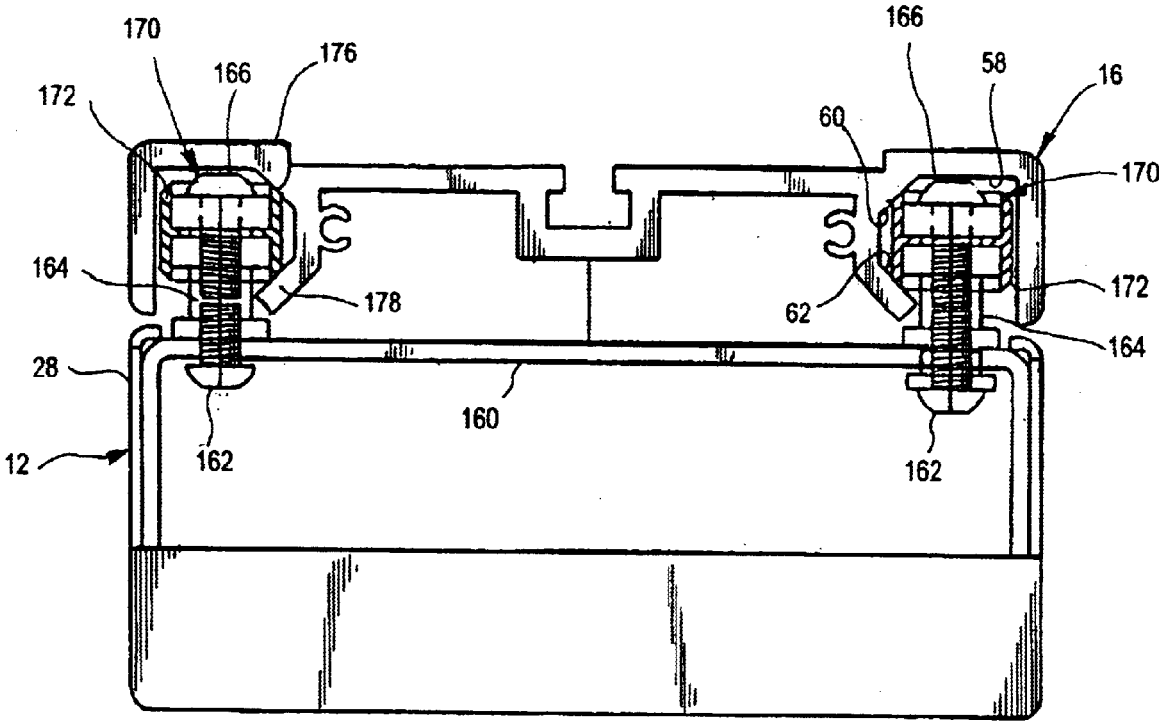
FIG. 14 is a sectional end view of a second embodiment of the base and table shown in FIGS. 2A–2B with the ink tray removed.

This roller configuration is the second embodiment of applicant's invention and is shown in FIG. 14. In this embodiment, the nylon bearings 44 have been replaced by a roller assembly (shown generally at 170). While only one pair of roller assemblies are shown, it is to be understood that the preferred embodiment has two pairs of spaced-apart roller assemblies mounted on the base 12, with each pair lying on opposing sides of the other pair. In the second embodiment, the face plates 28 do not form flange sections on which the bearings are mounted, like those found in the first embodiment. Instead, the roller assemblies 170 are mounted directly on plate surface 160 of base 12 by nuts 162.

Each roller assembly 170 has a spacer 164 fixedly mounted to plate surface 160 by nut 162. Nylon bearing 172 is rotatably mounted on spacer 164. Nylon bearing 172 and spacer 164 both have a bore along their central axis for receiving a spindle 166. Spindle 166 keeps nylon bearing 172 mounted to spacer 164 and also serves as the shaft/axis along which bearing 172 can rotate. Bearing 172 can freely rotate along spindle 166 because the bore in bearing 172 is not threaded.

Nylon bearing 172 has angled outer surfaces 176 and 178 which rotatably slide along and against corresponding inner surfaces 60 and 62 of the table 16. As seen FIG. 14, these surfaces 176 and 178 face inwardly in a generally horizontal direction. In operation, when the table 16 slides back and forth, the bearings 172 correspondingly rotate along and against the inner surfaces of the sliding table. In this fashion, the table 16 sides in a fixed path, along an essentially low-friction track.

The outer surfaces 176 and 178 of the bearings 172 exert a sideways horizontal force against the table track surfaces 60 and 62. The sideways force is met by a counteracting reactive force on the inner surfaces 60 and 62 of the track, which hold the table 16 in position between the bearings 172.

Referring again to FIG. 1, the table 16 carries what is commonly referred to as a turntable 66 and a print plate assembly (sometimes called "pad printer print tray" or "print tray" or "ink tray unit") 68. Both assemblies are connected to the table 16 by means of a slot 70 which runs along the length of the table's upper side 72. The position of both assemblies 66, 68 along the table may be adjusted by sliding them along the slot 70. They are fixed in position relative to the table 16 by one or more thumbwheel screws 74 which are threaded through the table into each assembly 66, 68. Tightening the thumbwheel screws 74 clamps each respective assembly 66, 68 tightly against the table 16. This arrangement is conventional and would be familiar to the skilled person.

The construction of the turntable assembly 66 is conventional Since it is not part of the claimed invention, further description of its features will not be required in order to construct the preferred embodiment of the invention.

The pad printer 10 is the same as the prior art in general principal and operation in that the table 16 is reciprocating and carries a turntable 66 and print plate assembly 68. However, the print plate assembly 68 has an automated inking and wiping feature which is believed to be unique.

Referring first to FIG. 1, the print plate assembly 68 has a tray 76, with a flat surface area 78 (see FIGS. 2A–2B), and an ink reservoir 80. A print plate (which bears the image that is to be printed on an object) is laid flat on surface area 78 and retained in place by a clip 82. These features are more or less the same as other pad printers.

Figure 11:
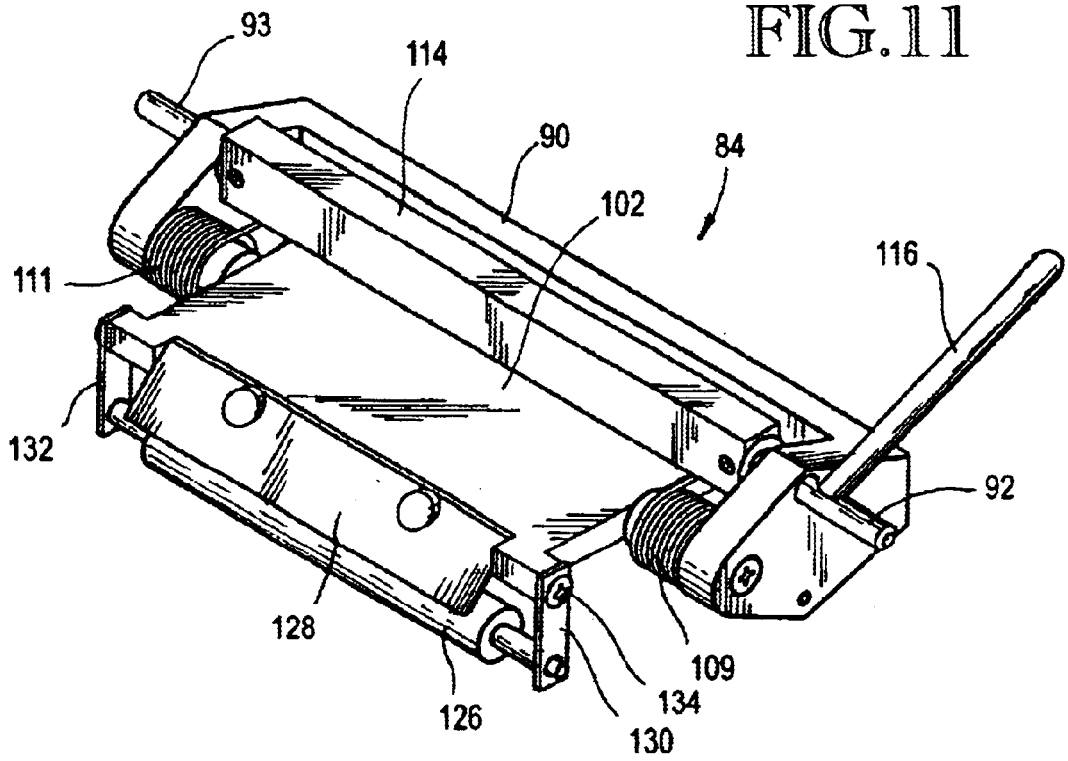
FIG. 11 is a pictorial view of the roller and wipe cartridge shown in FIG. 8.
Figure 12:
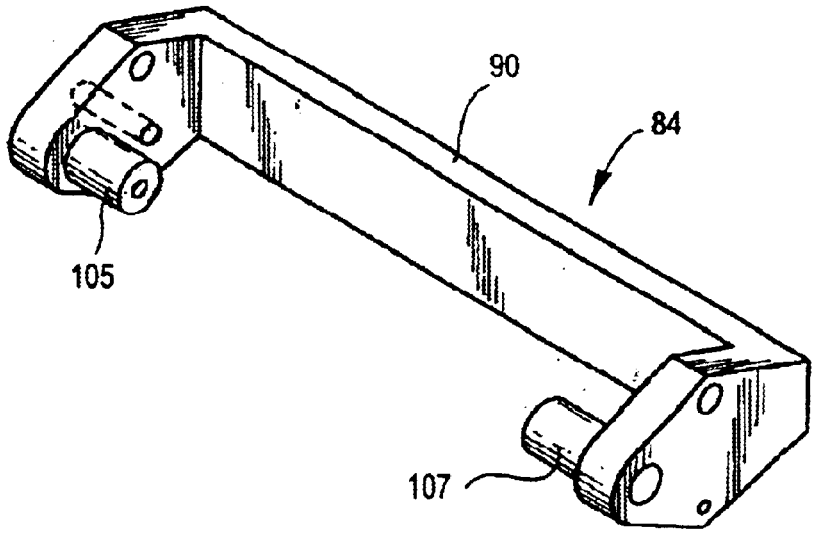
FIG. 12 is a pictorial view of frame which holds the various components making up the roller and wipe cartridge shown in FIGS. 8 and 11.

In the present invention, however, a roller and wipe cartridge ("cartridge") 84 (see FIGS. 1 and 11) is suspended over the tray 76 by vertical supports 86, 88 on each side of the base 12. The cartridge 84 has a frame 90 mounted to supports 86, 88 by end rods 92, 93 which are received in slots 94, 96 in each support 86, 88. While the means of attachment of the cartridge 84 to supports 86, 88 could vary, it is important that the rods 92, 93 be able to rotate for reasons described below. The frame 90 is prevented from rotating by another pin 98 (see FIG. 13) which is also received in slot 94 and fixedly connects one side 100 of the frame 90 to the support frame 88.

Figure 13:
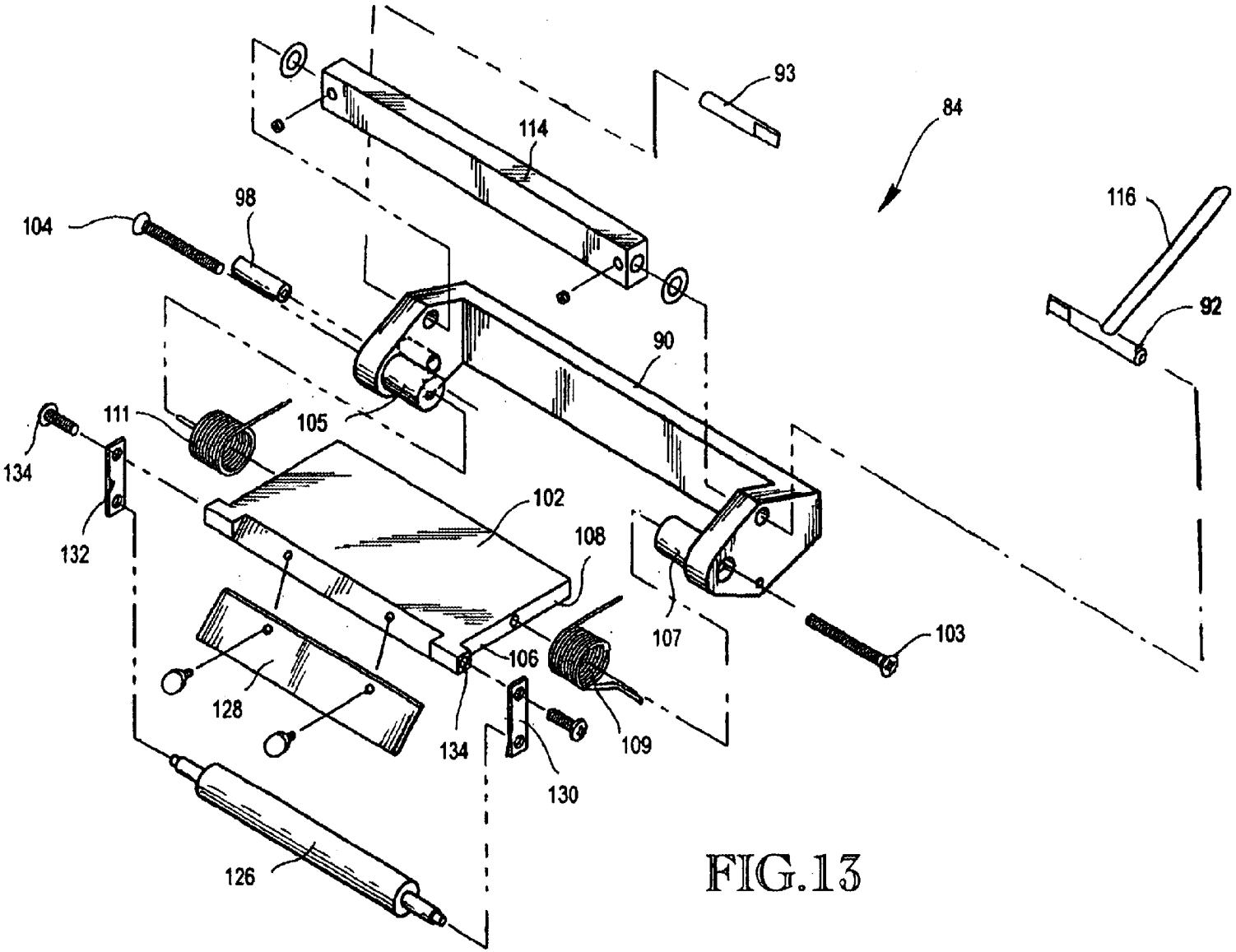
FIG. 13 is an exploded view of the roller and wipe cartridge shown in FIGS. 8 and 11.

The cartridge 84 has a horizontal plate 102 which is pivotally mounted to cartridge frame 90 by threaded screws 103, 104 which extend through hollow sleeve portions 105, 107 of the cartridge frame 90 (see FIG. 13). As is best seen in FIGS. 2A–2B, 12, and 13, one-half of the plate 102 extends out from the frame 90, as shown at 106. The other half stays generally within the frame, as shown at 108 (see FIG. 13). The plate 102 is spring biased so that the inner plate half 108, which is within the frame 90, is subject to a constant force that drives that section of the plate upward. Spring biasing is accomplished by springs 109, 111 which surround sleeve portions 105, 107.

Each one of end rods 92, 93 respectively extends through one side 110, 112 of cartridge frame 90. The inner ends of the rod ends 92, 93 are fixedly connected to a rectangular cam bar 114. In other words, the end rods 92, 93 and bar 114 turn together as a single unit.

A pivot rod or lever arm 116 is fixably connected to one of the end rods 92 and extends downwardly in a gap between one support frame 86 and one side of cartridge frame 110 (see FIG. 1). Moving the lever arm 116 causes the rectangular cam bar 114 to rotate against plate surface 108. In the position shown in FIG. 2A, plate surface 108 is at its uppermost position. When the lever arm 116 is rotated to the position shown in FIG. 2B, cam bar 114 is similarly rotated and pushes plate section 108 downwardly a small distance. This raises the plate's outermost end 120 a slight amount (see FIG. 2B).

The print tray 76 has flanges or abutments 122, 124 (see FIG. 1) which "trip" the lever arm 116 as the table 16 moves back and forth along the base 12. For example, when the table 16 is moved to the right-hand most position shown in FIG. 2A, abutment 122 on the tray pushes the lever arm 116 to the right. This, in turn, rotates the cam bar 114 so that the interior half 108 of plate 102 is at its uppermost position. At the same time, the outer edge 120 of the plate 102 is at its lowermost position.

Figure 2B:
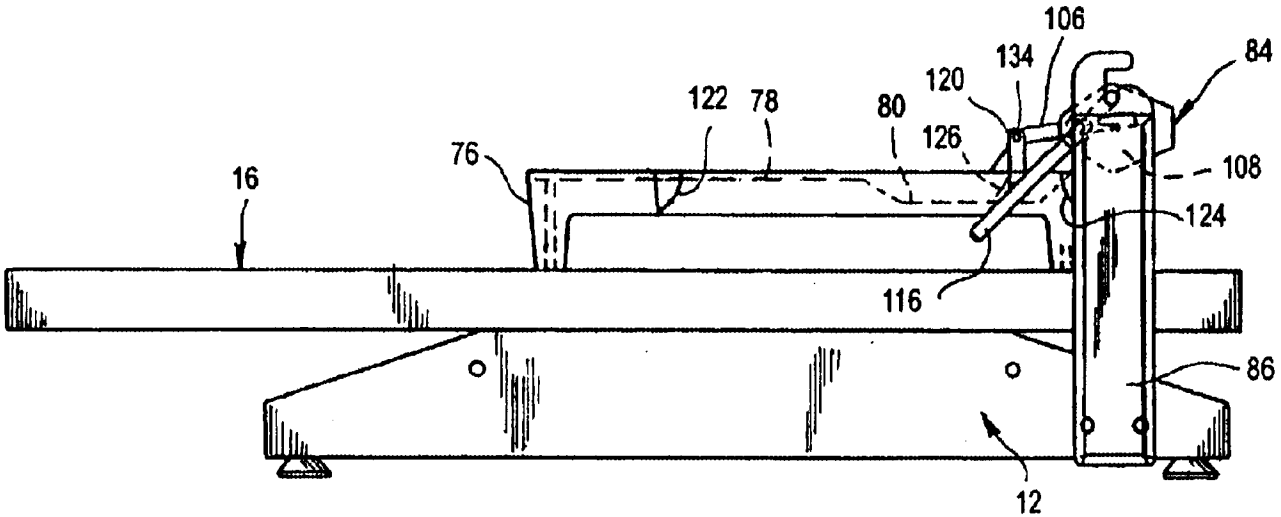
FIG. 2B is a view like FIG. 2A, but shows the table moved to the left, where it would normally be positioned directly below a print pad.

When the table 16 is moved to the left-hand most position shown in FIG. 2B, the other abutment 124 pushes the lever arm 116 to the left as shown in the FIG. This turns the cam bar 114 in the opposite direction, thereby raising the outer edge 120 of the plate 102 slightly.

The outer edge 120 of the plate 102 carries both a roller 126 and a wipe plate or ink wipe 128. The roller 126 is connected to the plate 102 by two side bars 130, 132, which are pivotally connected to the plate at 134, as shown in FIG. 13.

The roller 126 swings freely relative to the plate 102. When the table 16 is in the position shown in FIG. 2B, the roller 126 hangs downwardly into the ink reservoir 80 so that its outer surface is dipped and rolled in ink. As the table is moved from the position shown in FIG. 2B to 2A, the roller follows the contour of the tray 76 and rolls across the print plate positioned on surface 78. When the table 16 is moved as far as it can go to the right, the lever arm 116 is pushed from left to right. This lowers plate end 120 slightly and brings the ink wipe 128 into contact with the print plate. Then, as the table 16 is moved back to the position shown in FIG. 2B, the ink wipe 128 swipes the printer plate and removes excess ink from the plate, except for the image which has been completely inked. At that point, the tray and print plate are directly below a print pad 136 (see FIG. 1) that is carried by support 18.

As with conventional pad printers, the print pad 136 is brought down onto the print plate by means of the arm 22 and picks up the image from the print plate. When the arm 22 is released, the print pad 136 is raised relative to the tray, and the tray is then moved back to the position shown in FIG. 2A. At the same time, the turntable 66 is moved beneath the print pad 136. The turntable 66 carries the item upon which the image is to be printed. Printing is accomplished by once again driving the print pad 136 down onto the object by means of arm 22.

The basic operation of the pad printer 10 would be understood and known by the skilled person. The difference between the pad printer 10 described above and the prior art lies in the way the table 16 is slidingly mounted to the base 12 and how the cartridge 84 operates. More specifically, at least with respect to the cartridge 84, the difference is that the cartridge 84 has a pivot plate 102 which automatically wipes the print plate just before the plate is positioned underneath the print pad 136. In the past, wiping was done by a separate hand-operation. Also, an important feature of the invention is that the cartridge 84 is releasably mountable to the pad printer 10 as a single unit. This makes cartridge 84 and tray 76 cleaning much easier.

Figure 15:
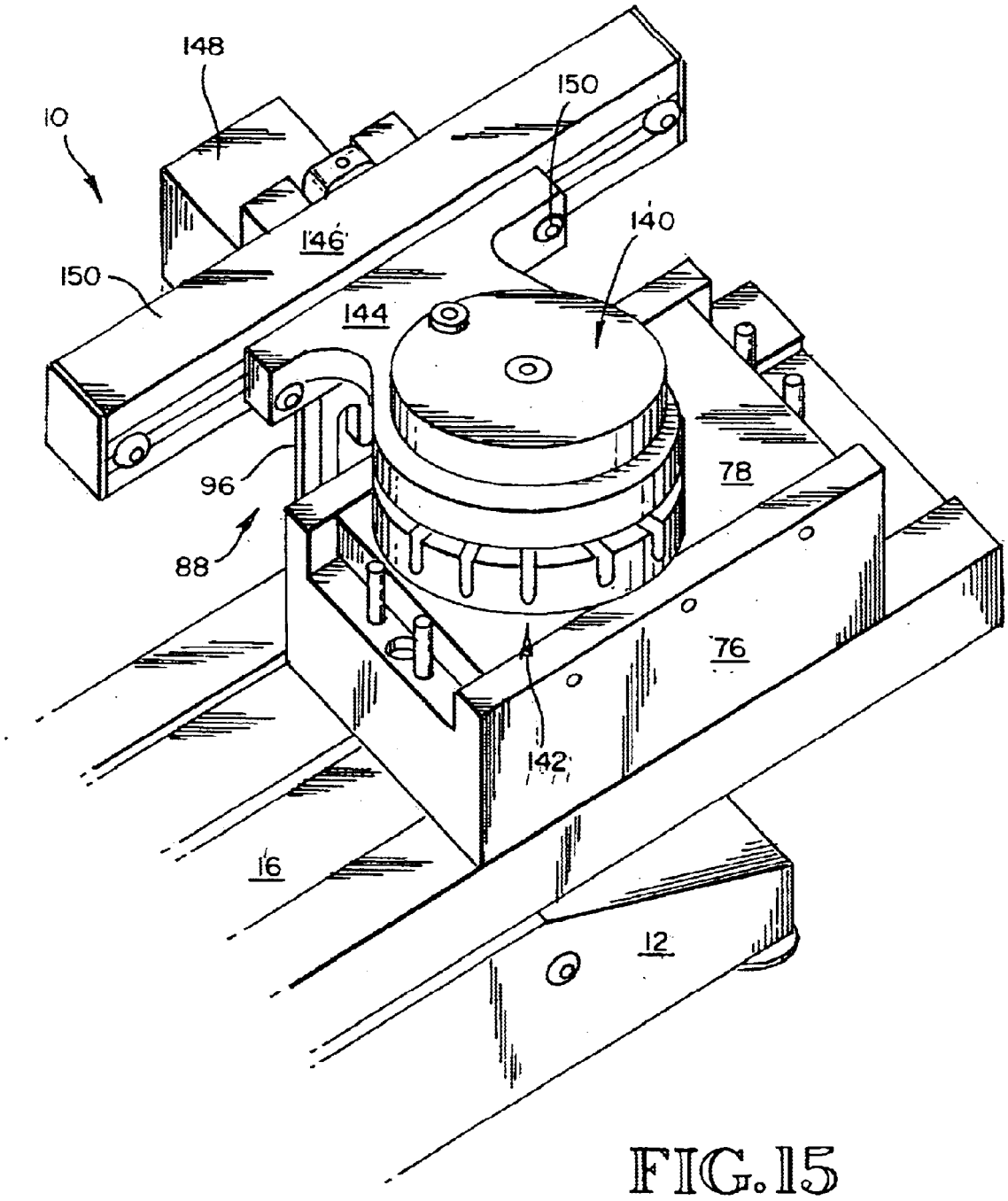
FIG. 15 is a partial pictorial view of the sealed ink cup assembly that replaces the roller and wipe cartridge shown in FIGS. 8–13.

Alternatively, the roller and wipe cartridge 84 is replaced by a sealed ink cup. The pad printer can use either the roller and wipe cartridge assembly or the sealed ink cup interchangeably by simply replacing one with the other. Referring now to FIG. 15, shown generally at 140 is a sealed ink cup. Sealed ink cups such as this are known in the art, but have never before been used in conjunction with printers having sliding table of the present invention.

The ink cup 140 has an internal reservoir containing ink. The bottom surface 142 of the ink cup is flat and contacts the surface 78 of the tray 76 that bears an image. In operation, ink diffuses out of openings located on the bottom surface 142 of the ink cup and on to the image on surface 78. Accordingly, there is no need for a separate supply of ink in the tray 76. Alternatively, a different type of tray can be used, such as that shown in FIG. 14, where the tray is simply a flat surface 78 with an image and does not have an ink reservoir 80.

Because the cartridge 84 is releasably mounted to the pad printer, it is a simple matter to remove the cartridge 84 and replace it with the ink cup 140. As seen in FIG. 15, the ink cup 140 is mounted to the vertical support 88 of the pad printer. Any means of attachment of the ink cup 140 to the vertical support 88 can be used. For example, the mounting bracket 146 attached to the ink cup 140 may be attached at slot 96 located in vertical support 88. In FIG. 15, the mounting bracket 146 is shown attached to the top of support 88 by a screw 148. The screws 150 connecting bracket 144 to mounting bracket 146 allow easy replacement of empty or defective ink cups 140 without the need to remove the mounting bracket 146 from the support 88.

The operation of the pad printer with the ink cup attachment is almost the same as with the embodiment using the cartridge 84. The ink cup 140 is first positioned over the tray 76 then the table 16 is moved to the right-hand most position, such as that shown in FIG. 2A, the bottom surface 142 of the ink cup 140 swipes the image on surface 78 of the tray 76. As the table 76 is moved back to the left, the bottom surface 142 moves off the image on surface 78. This back and forth movement also simultaneously wipes excess ink from the image. After the image is inked, the transfer of the inked image on to an object proceeds as before. The print pad 136 would pick up the inked image and print it onto an object positioned on turntable 66.

The invention as described above sets forth the preferred embodiment as it is currently known. It is no intended that the above description limit the scope of what is considered to be the invention. Instead, the scope of the invention is to be limited only by the subjoined claims which follow, the interpretation of which is to be made in accordance with the standards doctrines of patent claim interpretation.

What is claimed is:

1. A reciprocating table for a pad printer, comprising:

a base;

a table for carrying, respectively, an ink tray unit and a turn table for holding an item upon which printing is to be affixed; and at least one pair of parallel, spaced apart elongated bearing members mounted to the base and facing each other in a generally horizontal direction, the bearing members being made of synthetic material, and further, the bearing members being adapted to slidingly engage the table with the base, for enabling the table to slidingly move back and forth relative to the base.

2. The table of claim 1, wherein the table has a pair of elongated channels facing outwardly in a generally horizontal direction, and the bearing members each have inwardly facing surfaces shaped to slidingly engage with corresponding surfaces of the elongated channels.

3. The table of claim 2, wherein the base has a pair of elongated, horizontal flange portions, each flange portion extending inwardly toward the other, and the bearing members each have an elongated slot, the slot of each bearing member receiving one of the horizontal flange portions for mounting the bearing members to the base.

4. The table of claim 1, wherein the bearing members are made of a nylon material.

5. A reciprocating table for a pad printer, comprising:

a base;

a table having an upper surface and a lower surface, the upper surface carrying, respectively, an ink tray unit and a turntable for holding an item upon which printing is to be affixed, the lower surface defining a pair of parallel, spaced apart tracks;

bearing means, mounted to the base and facing inwardly in a generally horizontal direction, for slidingly engaging the table with the base, wherein the bearing means cooperates with the table tracks to mount the table to the base in a manner such that the table is reciprocatable back and forth substantially along the same path.

6. The table of claim 5, wherein the bearing means comprises at least one pair of parallel, spaced apart elongated bearing members mounted to the base so as to horizontally engage the table tracks.

7. A cartridge for rolling and wiping ink on a pad printer print tray, comprising:

a frame;

a first member pivotally mounted to the frame, the first member carrying both an elongated ink wipe and an ink roller;

at least one spring interconnecting the first member and frame, for biasing pivoting movement of the first member in one rotational direction;

a second member rotationally mounted to the frame, the second member having at least one camming surface that contacts the first member and arranged to pivot the first member against the bias of the spring when the second member is rotated in a certain direction, for bringing the ink wipe into contact with an area on the pad printer tray.

8. The cartridge of claim 7, wherein the pad printer tray is moveable back and forth relative to the cartridge, and including a downwardly extending lever arm fixably connected to the second member of the cartridge for effectuating movement of the second member against the first member, and wherein the pad printer tray has abutments which push the lever arm back and forth as the tray moves back and forth.

9. The cartridge of claim 7, wherein the cartridge is removeably mountable to a pad printer.

10. A reciprocating table for a pad printer, comprising:

a base;

a table having an upper surface and a lower surface, the upper surface carrying, respectively, an ink tray unit and a turntable for holding an item upon which printing is to be affixed, the lower surface defining a pair of parallel, spaced apart tracks;

a set of spaced apart bearings mounted to the base and having bearing surfaces facing in a generally horizontal direction for slidingly engaging the table with the base, wherein the set of bearings cooperates with the table tracks to mount the table to the base in a manner such that the table is reciprocatable back and forth substantially along the same path.

11. The reciprocating table of claim 10, wherein the set of bearings includes at least four bearings, two of which are slidingly engaged with one of the tracks on the lower surface of the table, and the other two bearings are slidingly engaged with the other track.

12. The reciprocating table of claim 10, wherein the bearings are made of a nylon material.

* * * * *